US005926872A

United States Patent [19]

Rossdeutscher

[11] Patent Number: 5,926,872

[45] Date of Patent: Jul. 27, 1999

[54] BED SYSTEM

[76] Inventor: Ralph H. Rossdeutscher, 6 Landsdowne Road North, Cambridge, Ontario, Canada, N1S 2S8

[ * ] Notice: This patent is subject to a terminal disclaimer.

[21] Appl. No.: 08/999,680

[22] Filed: Dec. 10, 1997

Related U.S. Application Data

[63] Continuation-in-part of application No. 08/607,991, Mar. 4, 1996.

[30] Foreign Application Priority Data

Apr. 10, 1995 [CA] Canada ..... 2146706

[51] Int. Cl.[6] ..... A47C 23/06

[52] U.S. Cl. ..... 5/236.1; 5/613; 5/618

[58] Field of Search ..... 5/236.1, 238, 617, 5/239, 241, 226, 191, 227, 228, 306; 24/712, 115 H

[56] References Cited

U.S. PATENT DOCUMENTS

| | | | |
|---|---|---|---|
| 41,526 | 2/1864 | Merrill | 5/618 |
| 56,211 | 7/1866 | Guyer . | |
| 1,922,104 | 8/1933 | Lukens | 5/618 |
| 2,606,329 | 2/1952 | Connally . | |
| 4,103,170 | 7/1978 | Spradlin | 5/620 |
| 4,477,935 | 10/1984 | Griffin | 5/236.1 |
| 4,644,596 | 2/1987 | Hüsler | 5/236.1 |
| 4,827,544 | 5/1989 | Hüsler | 5/236.1 |
| 5,233,709 | 8/1993 | Horry | 5/236.1 |
| 5,280,658 | 1/1994 | Sigl | 5/236.1 |
| 5,524,307 | 6/1996 | Griffin | 5/455 |
| 5,553,338 | 9/1996 | Amann . | |

FOREIGN PATENT DOCUMENTS

| | | | |
|---|---|---|---|
| 0 385 121 B1 | 8/1991 | European Pat. Off. . | |
| 3905879 | 8/1990 | Germany | 5/236.1 |

*Primary Examiner*—Steven Meyers
*Assistant Examiner*—Teri Pham
*Attorney, Agent, or Firm*—R. Craig Armstrong

[57] ABSTRACT

The bed system has a rectangular frame, with a mattress assembly mounted on the frame. The mattress assembly has upper and lower wooden strip layers and intervening foam blocks. Each wooden strip layer has a plurality of laterally-oriented wooden strips arranged in proximity to each other from top to bottom of the frame, with each strip extending from one side panel to the other side panel. There are three foam blocks, namely two outer foam blocks and one central foam block, running from head to foot of the bed between the wooden strip layers. The side panels have inwardly-facing shoulder portions running the length thereof, and the wooden strips of the lower wooden strip layer rest on the shoulder portions, with the outer foam blocks extending outwardly beyond the wooden strips so as to be in general vertical alignment with the outer walls of the side panels. This permits conventional North American fitted sheets and/or bed skirts to be used if desired. Spaced-apart buttons on the outside of each outer foam block are tied to corresponding buttons on the opposing outer foam block, to prevent the foam blocks from moving laterally outwardly beyond the outer walls of the side panels. Preferably the bed system includes at least one elevating mechanism to permit the head of the bed and/or lumbar and leg portions to be raised. In double, queen or king sized versions of the invention, a central support member runs longitudinally between the head and foot panels, with support rails on either side thereof. Two of the mattress assemblies are arranged side by side, one on either side of the central support member, the central support member being configured to act the same as a side panel for each of the two mattress assemblies.

18 Claims, 15 Drawing Sheets

BED SYSTEM

REFERENCE TO RELATED APPLICATION

This is a continuation-in-part of application Ser. No. 08/607,991, filed Mar. 4, 1996.

BACKGROUND OF THE INVENTION

This invention relates to bed systems, and in particular to a combination of a bed frame with a mattress assembly, where the mattress assembly is of a type having multiple lateral wooden strips arranged in two layers, with longitudinal foam elements between the two layers. Each wooden strip layer has a plurality of relatively thin, somewhat flexible laterally-oriented wooden strips arranged in proximity to each other from top to bottom of the mattress assembly, with each strip extending from one side of the mattress assembly to the other. There are typically three foam blocks, namely two outer foam blocks, one at each outer edge of the mattress assembly and running the length thereof, and one central foam block located centrally between the outer foam blocks and running from head to foot of the bed between the wooden strip layers.

Mattress assemblies of the same general type as in the invention are not new. There presently exist, primarily in Europe, mattress assemblies which involve similar wooden strip and foam arrangements. See for example European patent document no. 0 385 121 B1. However, such systems are not presently adapted to optimum use in North American bed frames, which are generally constructed on quite a different principle.

In typical North American bed systems, the mattress is supported on a platform, or more usually on a box spring unit, with no frame pieces extending upwardly along the sides of the mattress. It is common to use a fitted sheet over the mattress, so that the bed can be made very easily. Also, bed skirts are commonly used, to extend under the mattress and hang down to the floor over the box spring or platform.

In typical European bed systems, however, the mattress is supported on a platform or slats, with frame pieces extending upwardly along the sides and ends of the mattress, i.e. the mattress is sunken into the frame. If one attempts to use this type of mattress assembly in a typical North American bed system, several problems arise.

First of all, if a European-style frame is constructed so as to fit onto North American bed rails, it follows that the mattress must be sized slightly smaller than a standard North American mattress so that it can fit within the frame (since the frame must have the same external dimensions as a standard box spring/mattress set in order to fit onto the rails). This means that standard North American fitted sheet sizes will be too wide for the mattress assembly (and also means that a small amount of sleeping width will be lost, to no advantage). It also means that a bed skirt cannot be used, since a bed skirt passing under the mattress assembly would have to then go up to get over the top of the side panel, which would result in the skirt being too short to extend down to the floor as desired. Alternatively, if the bed skirt was installed on top of the mattress assembly, it would still be too short, as will be explained in more detail later.

SUMMARY OF THE INVENTION

In view of the above, it is an object of the invention to provide a bed system which permits a mattress assembly of the above-mentioned type to be used in the typical North American type of bed frame, in such a way that conventional fitted sheets and conventional bed skirts can be used, if desired.

Thus in the invention, the side frame pieces do not extend upwardly beside the mattress assembly. This allows the mattress assembly to extend out over the side frame pieces, to the full width of a North American mattress However, merely reducing the height of the side panels creates another problem. Without side panels extending upwardly beside the mattress assembly, there is nothing to prevent the mattress assembly from sliding laterally on its platform, nor is there anything to prevent the foam blocks from sliding laterally so as to no longer capture the wooden strips, i.e. the foam blocks are free to slide outwardly off the wooden strips. This lateral shifting is undesirable for a number of obvious reason, including the fact that it would rapidly result in a bed skirt becoming misaligned.

Therefore, in the invention, the wooden strips are set back from the outer edges of the outer foam blocks, and the side panels are provided with shoulder portions on which the lower wooden strips rest. The shoulder portions extend only minimally upwardly beyond the level of the wooden strips, or preferably not at all, which allows the outer edges of the outer foam blocks to extend outwardly to align with the outer edges of the side panels, thereby providing conventional North American mattress width. A headboard or footboard and/or other means such as pins projecting upwardly between lower wooden strips preferably are used to prevent longitudinal shifting.

It is an object of the preferred embodiment of the invention to also provide a means for preventing the outer foam blocks from sliding outwardly so as to no longer capture the wooden strips. Thus in the preferred embodiment, means such as wooden buttons are positioned outside the outer foam blocks, and those on opposite sides are connected by strings, such that the foam blocks cannot move outwardly beyond the length of the strings.

There are two principal versions of the invention, namely a single bed version, and a version which may be used for double, queen or king size configurations.

In the single bed version of the invention, the bed system has a rectangular frame defined by four vertically-oriented panels, namely a head panel, a foot panel and two side panels. A mattress assembly of the type described above is mounted on the frame. The side panels have inwardly-facing shoulder portions running the length thereof, and the wooden strips of the lower wooden strip layer rest on the shoulder portions, with the outer foam blocks extending outwardly beyond the ends of the strips so as to be in general vertical alignment with the outer walls of the side panels. Therefore, when the frame is constructed to fit on a standard North American type of bed frame support, the width of the mattress assembly matches the width of a conventional mattress. As will be explained below, the overall thickness of the mattress assembly is comparable to that of a conventional North American mattress as well (although that varies). Thus purchasers of the bed system can use any fitted sheets they already have, thus avoiding the need to buy replacement flat sheets or custom-size fitted sheets. Also, for purchasers whose present beds include the use of bed skirts, or for purchasers who wish to use bed skirts, that is possible with the invention, whereas it is not possible for mattress assemblies which are sunken into the frame, as will be explained below.

Preferably the bed system includes elevating means pivotally mounted between the side panels, pivotable between lowered positions where the mattress assembly is not elevated above the frame, and at least one elevated position where at least a portion of the mattress assembly is elevated above the frame. This permits the person using the bed to raise a portion of the mattress assembly in the person's lumbar region, for example, and/or to provide for the upper portion of the bed to be elevated towards a sitting position and/or the lower portion of the bed to be elevated in the area of the person's legs.

In the double, queen or king sized version of the invention, the identical principles are employed, but there is a central support member running longitudinally between the head and foot panels, centrally between the side panels, with an upper surface at the same height as upper surfaces of the side panels. Two of the mattress assemblies are arranged side by side. The central support member has support rails on either side thereof running the length thereof, with shoulders as in the single bed version, so that the individual mattress assemblies are supported in essentially identical fashion as in the single bed version.

The invention provides a bed system which offers excellent comfort and which may offer therapeutic benefits for some users, particularly those with back trouble, and adapts that system advantageously for North American use.

Further features of the invention will be described or will become apparent in the course of the following detailed description. In the description, "head" will be used to refer to the end of the bed where the person's head would be located, and "foot" will be used to refer to the end of the bed where the person's feet would be located.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 22:
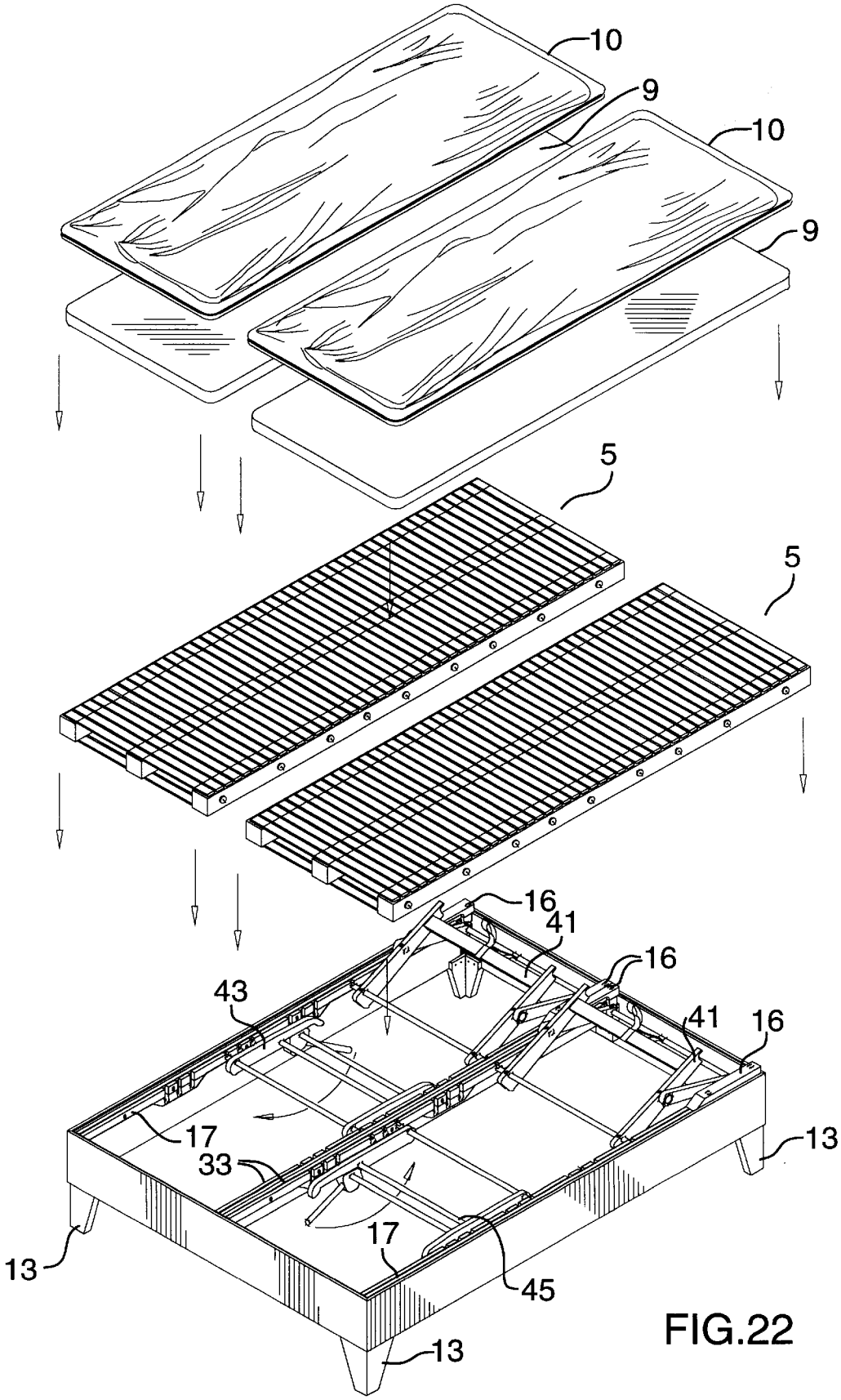
FIG. 22 is a perspective of a queen sized bed frame.
Figure 23:
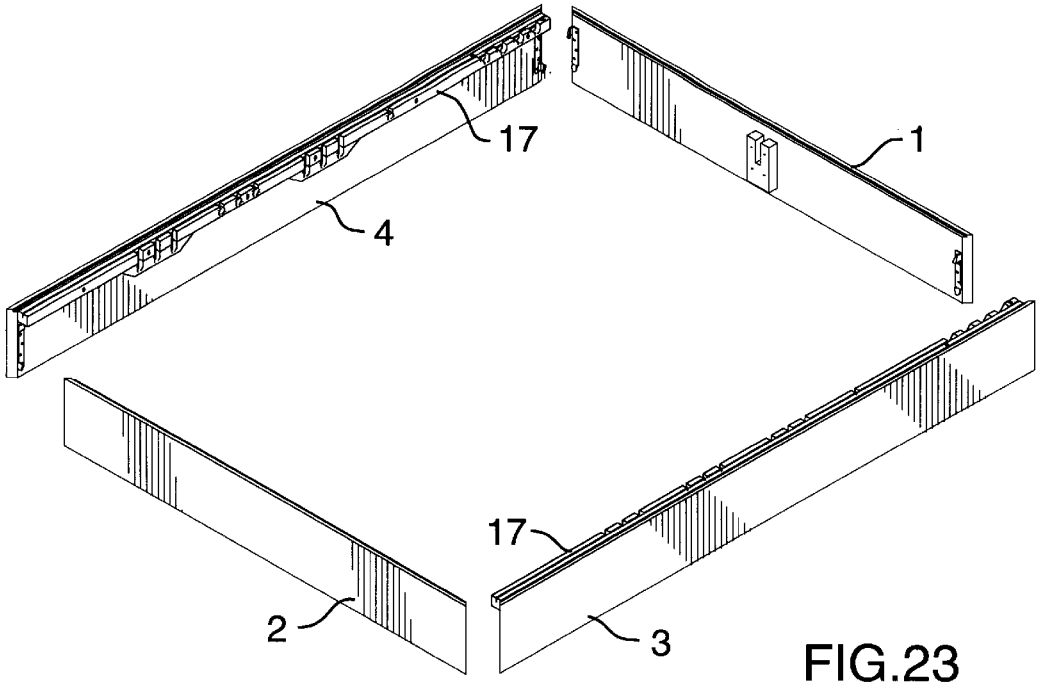
FIG. 23 is a perspective of queen sized bed frame, exploded.
Figure 24:
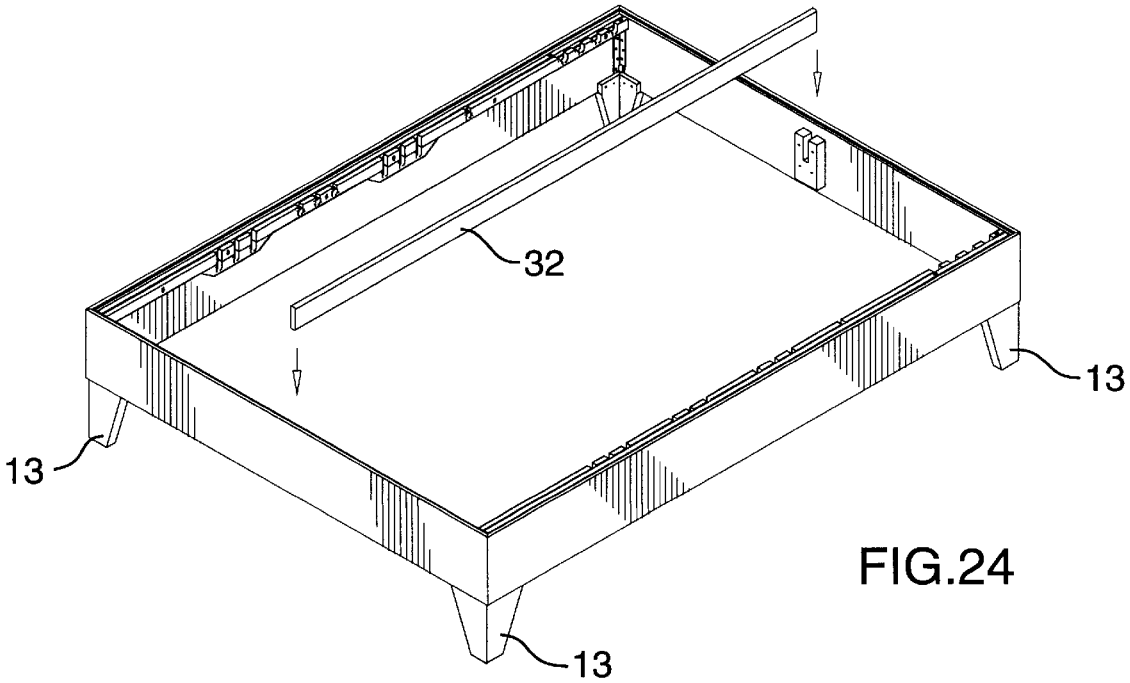
FIG. 24 is another perspective of the queen sized bed frame.

As mentioned above, there are two principal versions of the invention, namely a single bed version, and a version which may be used for double, queen or king size configurations. The single bed version is illustrated in FIGS. 1–21, while the larger version is illustrated in FIGS. 22–24. The single bed version will be described first.

In the single bed version, the bed system has a rectangular frame defined by four vertically-oriented panels, namely a head panel 1, a foot panel 2 and two side panels 3 and 4. A mattress assembly 5 is mounted on the frame, the mattress assembly having an upper wooden strip layer 6, a lower wooden strip layer 7, and intervening foam blocks 8. Each wooden strip layer has a plurality of relatively thin, somewhat flexible laterally-oriented wooden strips 39 arranged in proximity to each other from top to bottom of the frame, with each strip extending from one side panel to the other side panel. There are three of the foam blocks 8, namely two outer foam blocks, one adjacent each side panel and running the length thereof, and one central foam block located centrally between the side panels and running from head to foot of the bed between the wooden strip layers. A padded layer 9, preferably of foam approximately 5 cm thick with a removable 100% cotton cover, is positioned on top of the mattress assembly, extending substantially across the full width and length of the mattress assembly. Preferably positioned on top of the padded layer is a sheep's wool mattress pad 10, also with a cotton cover. The mattress assembly 5, padded layer 9 and mattress pad 10 produces an overall thickness which is generally within the range of thicknesses of a conventional North American mattress. A sheep's wool duvet and sheep's wool pillow (not illustrated) are preferably used to complete the bed system.

Figure 1:
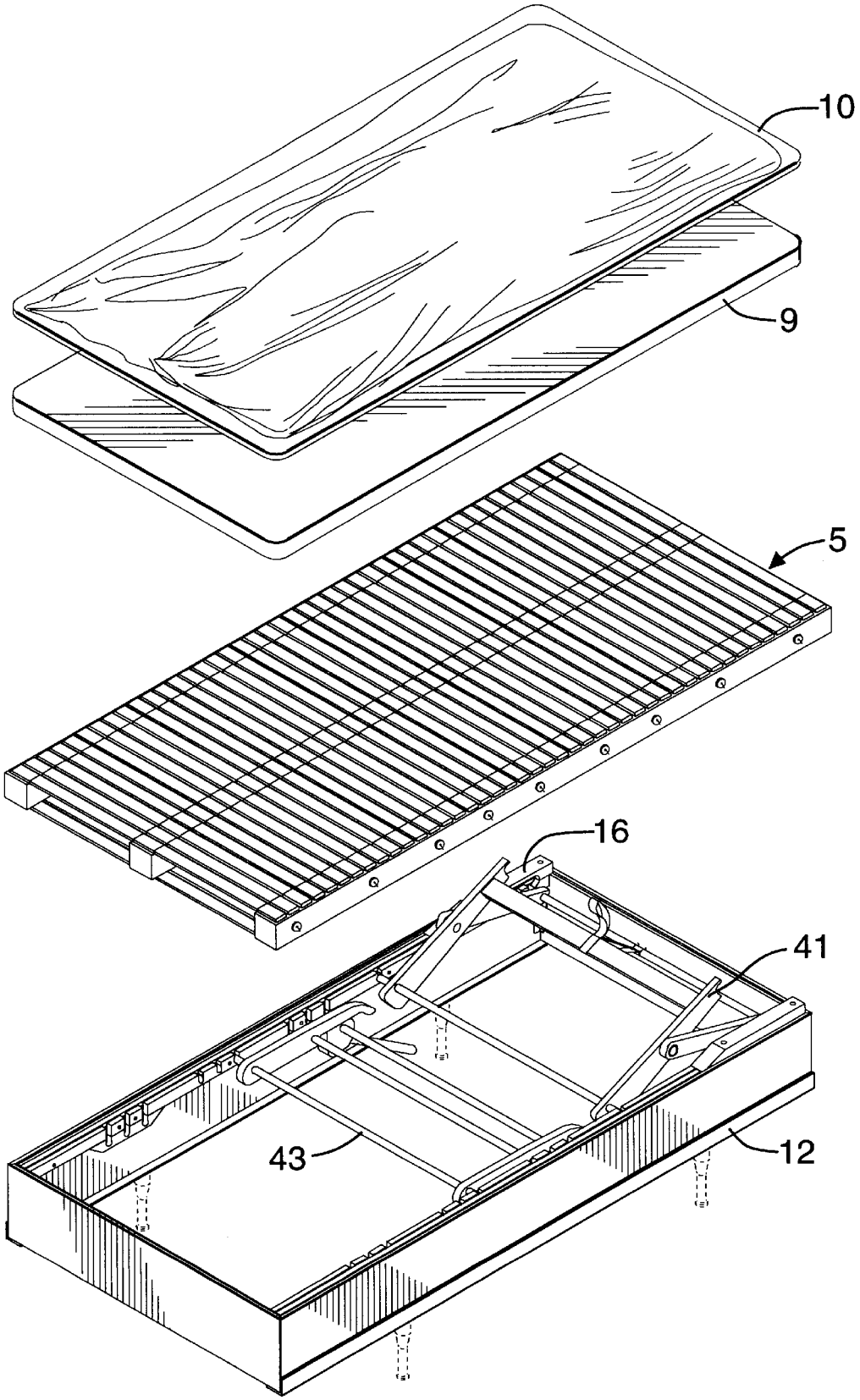
FIG. 1 is an exploded perspective view of the preferred embodiment, in a single bed version.
Figure 2:
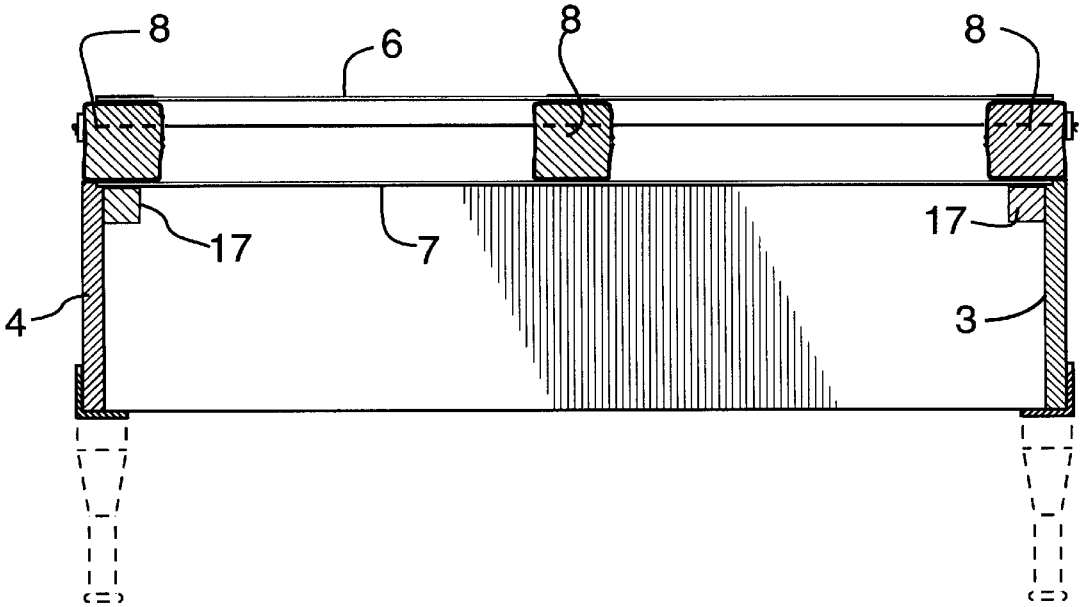
FIG. 2 is a lateral cross-section of the bed.
Figure 3:
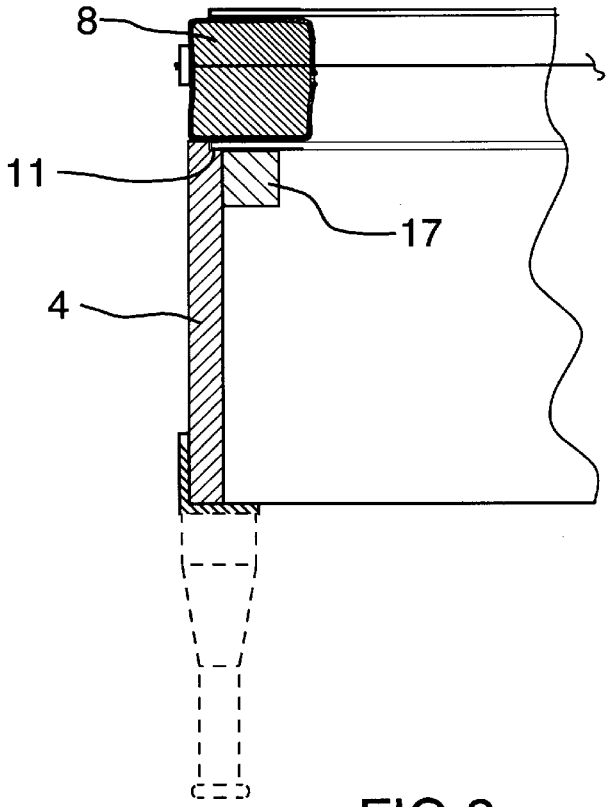
FIG. 3 is a lateral cross-section similar to FIG. 2, but on a larger scale.
Figure 4:
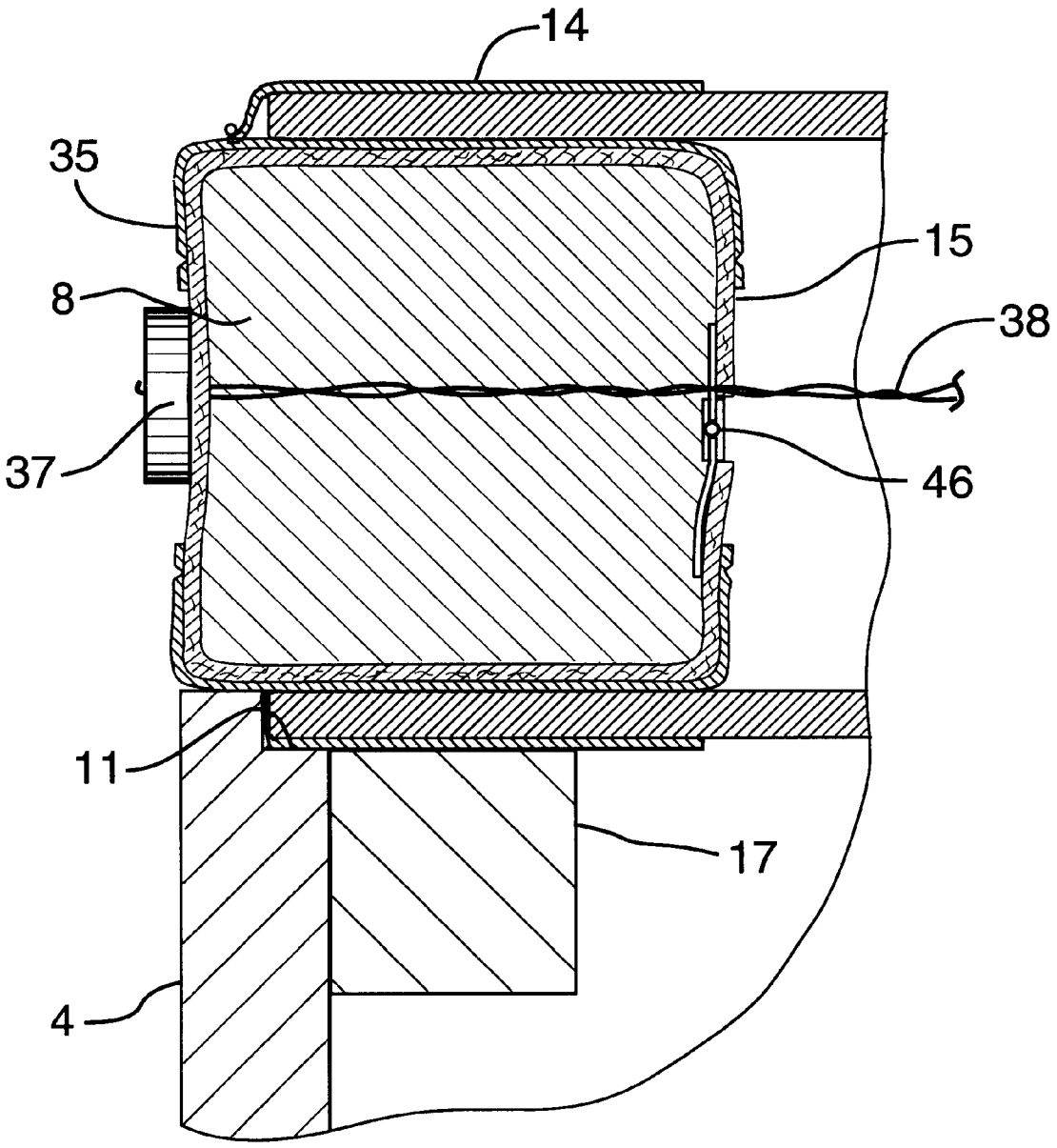
FIG. 4 is a lateral cross-section similar to FIGS. 2 and 3, but on a still larger scale.

The side panels have inwardly-facing shoulder portions 11 running the length thereof, the depth of the shoulders preferably being about the same as the thickness of the wooden strips. The wooden strips of the lower wooden strip layer rest on the shoulder portions. The outer foam blocks extend outwardly past the ends of the wooden strips, so as to be in general vertical alignment with the outer walls of the side panels. Therefore, when the frame is constructed to fit on a standard North American bed frame support, such as an angle-iron rail 12 as shown in FIGS. 2 and 3 for example, the width of the mattress assembly corresponds to the standard North American mattress width, thereby avoiding any need for non-standard sheets and other bedding material. Conventional fitted sheets (or unfitted sheets if desired) can be used to cover the mattress assembly, padded layer, and mattress pad, with the mattress assembly not being too narrow for that to be the case. The angle iron rail may be part of a conventional self-supporting frame, i.e. on legs, or may be conventionally installed between a headboard and footboard. Alternatively, as illustrated in FIGS. 10–22 and 24, the frame may be on its own supports, such as legs 13.

Figure 5:
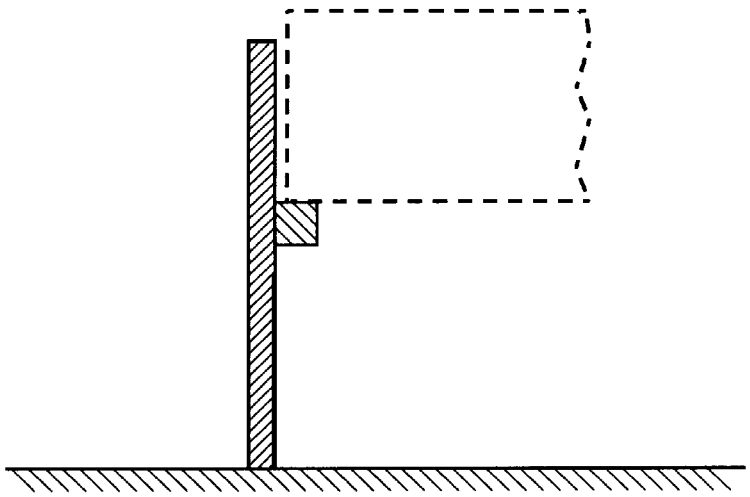
FIG.5 (PRIOR ART)
FIG. 5 is a schematic illustration of a typical prior art European bed frame.
Figure 6:
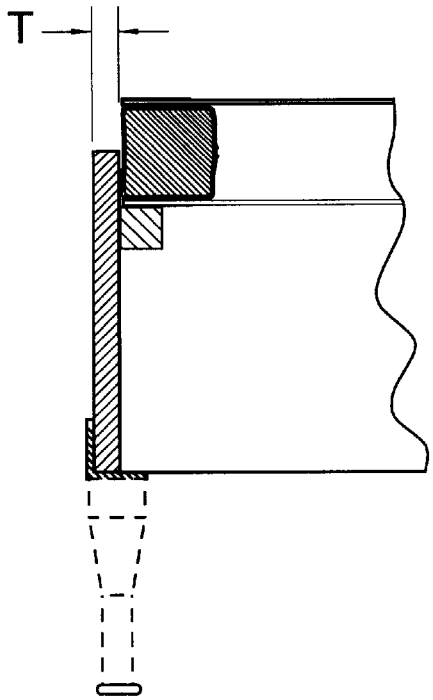
FIG.6 (PRIOR ART)
FIG. 6 is a lateral cross-section, showing how the prior art would obviously be adapted to North American bed frames.
Figure 7:
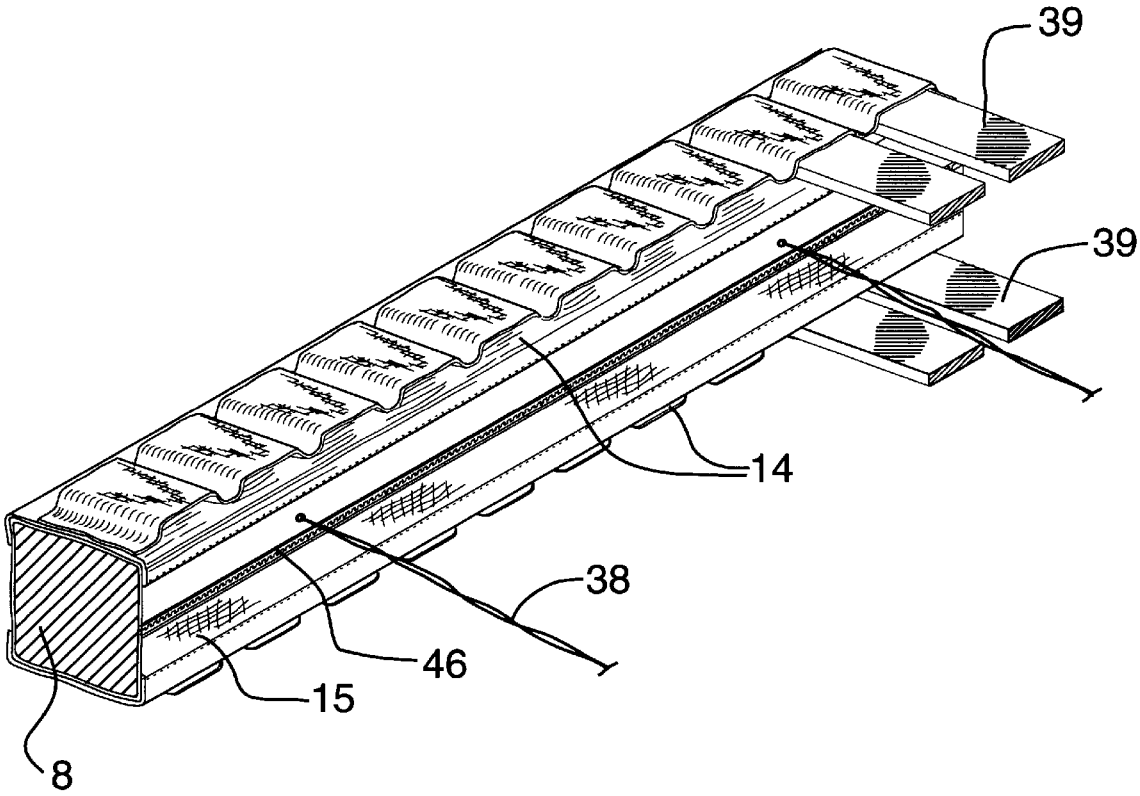
FIG. 7 is a perspective view showing an outer foam block, from the inside.
Figure 8:
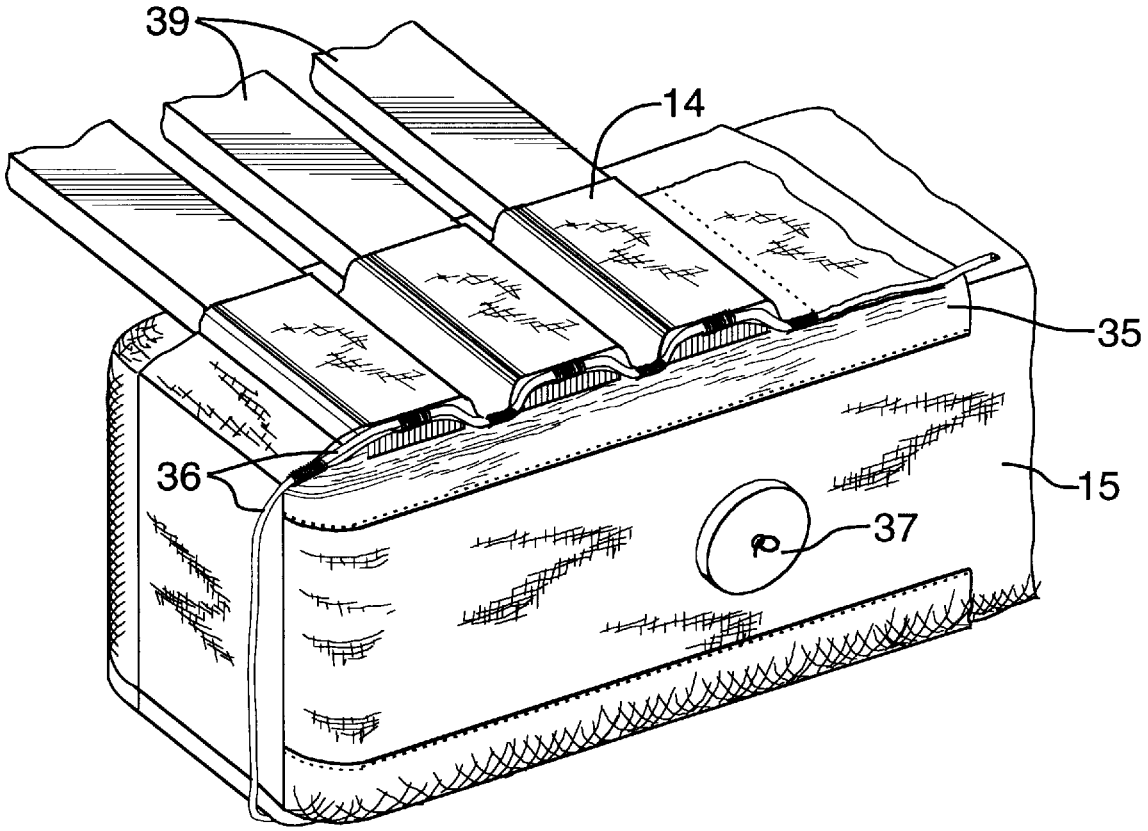
FIG. 8 is a perspective view showing an outer foam block, from the outside.
Figure 9:
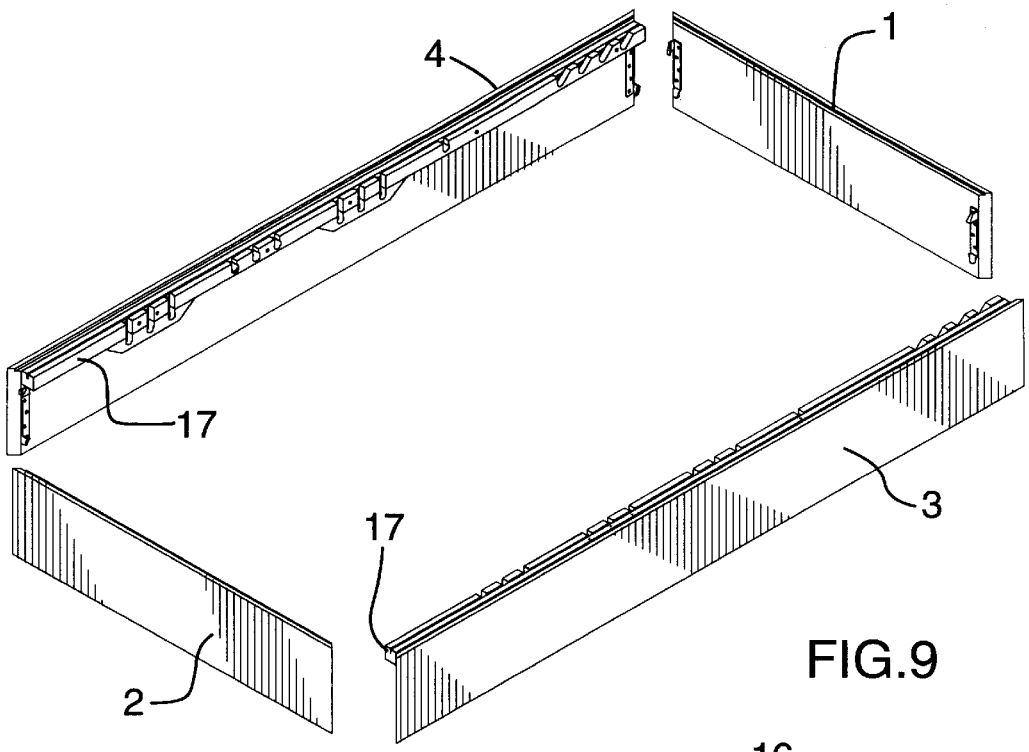
FIG. 9 is an exploded perspective view of the bed frame.
Figure 10:
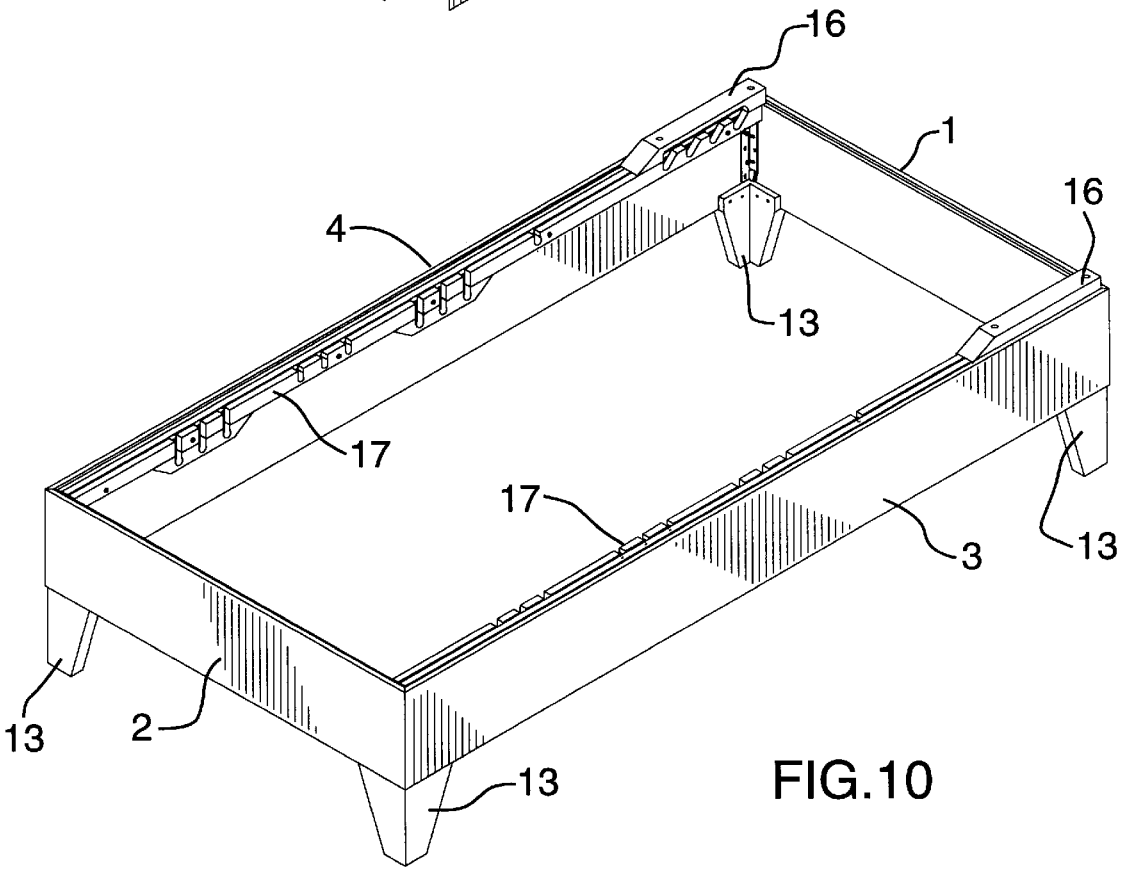
FIG. 10 is a perspective view of the assembled bed frame.
Figure 11:
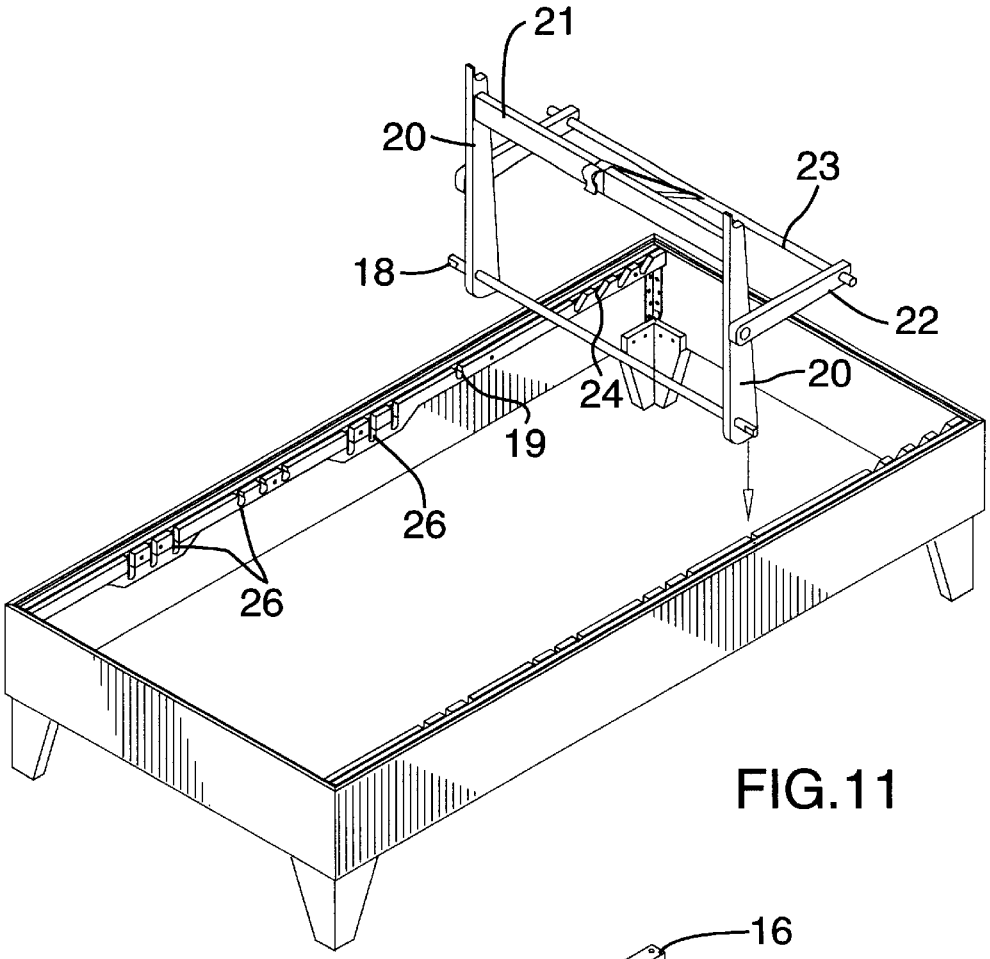
FIG. 11 is a perspective view similar to FIG. 3, but also showing the head elevating mechanism, exploded.
Figure 12:
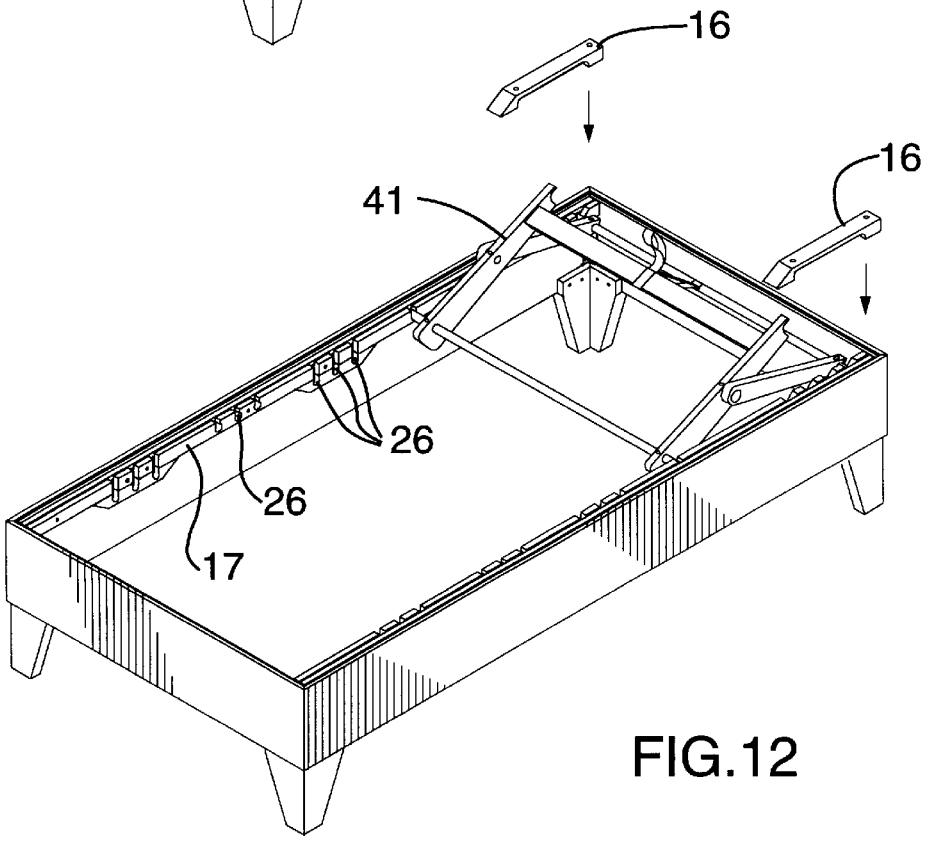
FIG. 12 is a perspective view similar to FIGS. 3 and 4, showing the head elevating mechanism installed.
Figure 13:
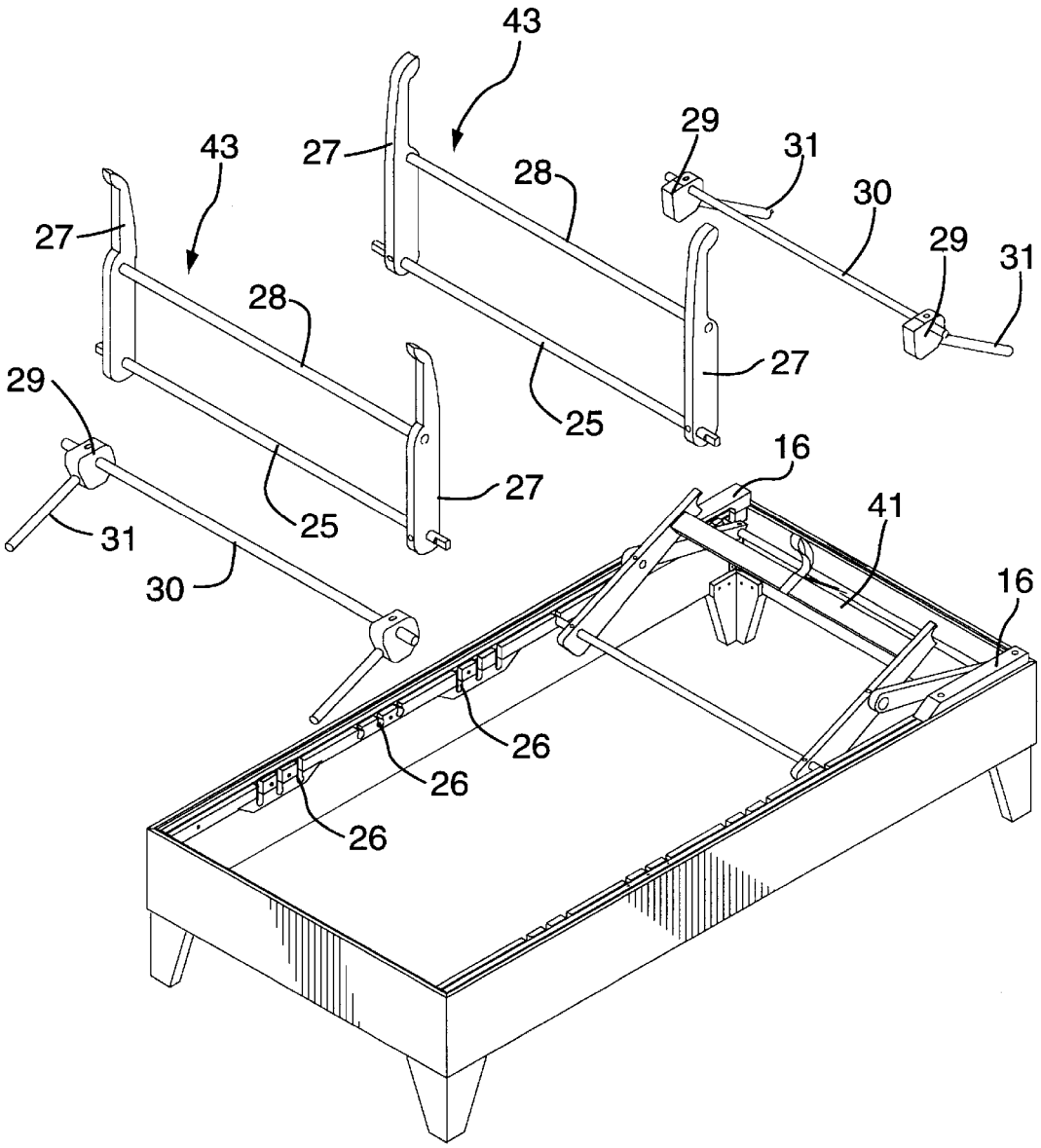
FIG. 13 is another perspective view, also showing the lumbar and leg portion elevating mechanisms.
Figure 14:
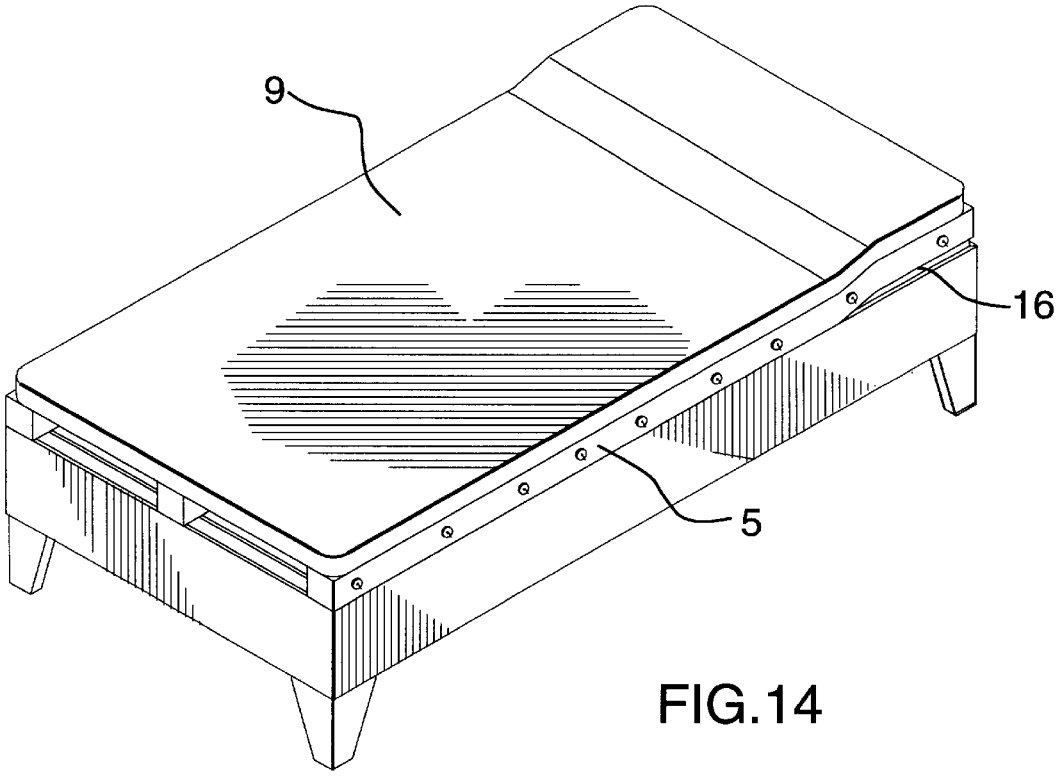
FIG. 14 is a perspective view showing the assembled bed system.
Figure 15:
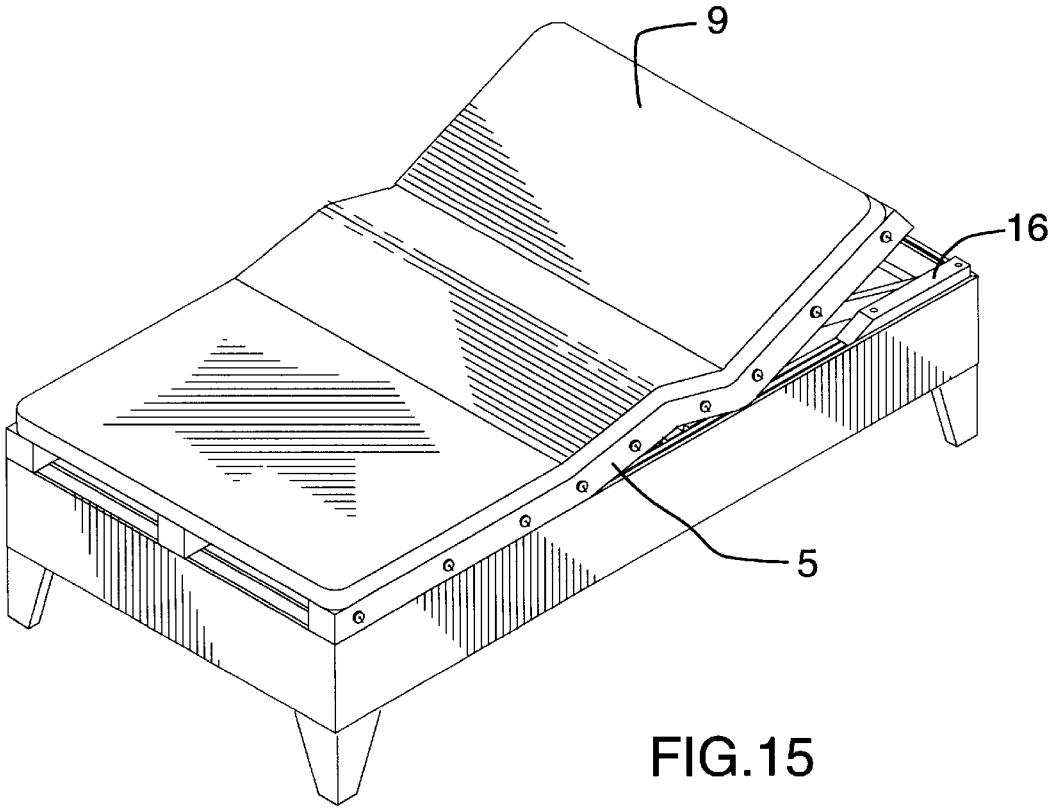
FIG. 15 is a perspective view similar to FIG. 7, showing the head and lumbar portions elevated.

By contrast, if the typical European construction shown schematically in FIG. 5 (prior art) was adapted to North American use in the obvious fashion shown in FIG. 6, the width of the mattress would be decreased by dimension T on each side of the mattress assembly. This is avoided in the present invention.

As can be seen most clearly in FIG. 2, this configuration has the additional advantage of permitting a conventional bed skirt to be used as well, if desired. The bed skirt would simply extend under the mattress assembly, and then extend down the side of the side panels 3 and 4; a skirt of the length normally used for a box spring would work with this configuration, the side panels 3 and 4 being of a height corresponding to the height of a box spring. By contrast, looking at FIG. 6, it can be seen that the obvious adaptation of the existing European mattress assembly would not have this advantage. A bed skirt passing under the mattress assembly would have to then go up to get over the top of the side panel, which would result in the skirt being too short to extend down to the floor as desired. Alternatively, if passed over the mattress assembly in an unconventional fashion, the bed skirt would still be too short because of the height of the top of the mattress assembly being greater than the height of a conventional box spring. A fitted sheet could then not be used at all, even as a poor fit, unless installed only on the equivalents of the padded layer 9 and mattress pad 10 of the present invention, where the fit would be terrible due to mismatching of both the width and the thickness.

In the preferred embodiment, the outer ends of the wooden strips are positioned in pockets 14 which are provided on material strips 35 along the outer foam blocks. The material strips are sewn onto material covers 15 which surround the foam blocks. The covers preferably are readily removable by virtue of a zipper 46 running the length of each cover. To keep the outer foam blocks extending beyond the ends of the wooden strips, the outer ends of the pockets preferably are closed off short of the outer edges of the outer foam blocks, by sewing them shut, or as in the preferred embodiment, by using drawstrings 36.

With the above construction, the main problem of adapting the European mattress assembly to North American bed frames is overcome. However, since the outer foam blocks are not captured by the frame pieces, it is preferable to also provide a means for preventing the outer foam blocks from sliding outwardly. Thus in the preferred embodiment, a number of spaced-apart wooden buttons 37 are positioned outside the outer foam blocks, and those on opposite sides are connected to each other by strings 38, such that the foam blocks cannot move outwardly beyond the length of the strings.

Clearly, other similar means could be employed. For example, it should be obvious that many different items could be substituted for wooden buttons, such as small plates, blocks or strips, for example. Similarly, many different items could be substituted for the strings, such as wire or straps, for example. Instead of individual buttons, there could be wooden strips extending along the outer sides of the outer foam blocks, tied together at spaced-apart locations. These strips would have to be interrupted periodically, however, unless it was not desired to be able to roll the mattress up (which is particularly convenient for boxing and shipping by courier, for example) and unless it was not desired that portions of the mattress be capable of being elevated as described below.

Another possibility, of course, would be to use suitable tacking or tying means to secure all or at least a number of the wooden strips to their pockets. From a labor and efficiency viewpoint, the drawstring method is preferable, but this method and other obvious variations theron clearly would also work.

Preferably but not necessarily, the mattress assembly is elevated slightly at the head end of the bead, to reduce the need for a thick pillow. This elevation is accomplished by virtue of wedges 16 at the head end of each side frame 3 and 4. The mattress assembly is raised from the shoulder portions 11 by these wedges, although the wedges themselves may be provided with similar shoulder portions if desired, to prevent any lateral shifting of the mattress assembly.

Preferably the bed system includes adjustable elevating means pivotally mounted between the side panels, pivotable between lowered positions where the mattress assembly is not elevated above the frame, and at least one elevated position where at least a portion of the mattress assembly is elevated above the frame. This permits the person using the bed to raise the upper portion of the bed towards a sitting position via an upper elevating assembly 41, and/or a portion of the bed in the person's lumbar region via a central elevating assembly 43, and/or a portion of the bed in the area of the person's legs via a lower elevating assembly 45.

In all embodiments of the invention, whether or not including elevating mechanisms, support rails 17 are provided on the inside of each side rail, at the height of the shoulder portions 11, so that the mattress assembly is not supported solely on the shoulder portions. The weight of the mattress assembly and of any person(s) on the bed is borne primarily by the support rails, with the shoulder portions serving primarily to prevent lateral shifting of the mattress assembly.

The mechanism for elevating the head of the bed is shown most clearly in FIGS. 1, 11, 12 and 18. It includes a pivot rod 18 which runs laterally from one side panel to the other, and is lodged in notches 19 in the support rails. Elevation supports 20 extend from the pivot rod towards the head of the bed on either side, and are connected by a crossbar 21. Partway along the elevation supports, braces 22 are pivotally connected. At their distal ends, they are connected by a crosspiece 23. The crosspiece extends between the side panels and can be positioned in any of several notches 24 in the support rails. As can be readily seen from the drawings, different elevations of the head end of the bed can be obtained by selecting different pairs of the notches 24.

The mechanism for elevating the lumbar region is shown most clearly in FIGS. 16–21. It includes a pivot rod 25 which runs laterally from one side panel to the other, and is lodged in any of several notches 26 in the support rails. Elevation supports 27 extend from the pivot rod towards the head of the bed on either side, and are connected by a crossbar 28. Cams 29 are pivotally mounted on the inside of each side panel, under the elevation supports 27, and are connected to each other via a torsion rod 30. A handle 31 is operable to rotate one of the cams, with the other following it by virtue of the torsion rod. Depending on the cam position, as seen in the drawings, different degrees of lumbar elevation are achieved. By selecting different pairs of the notches 26, the location of the lumbar elevation can be varied.

Figure 16:
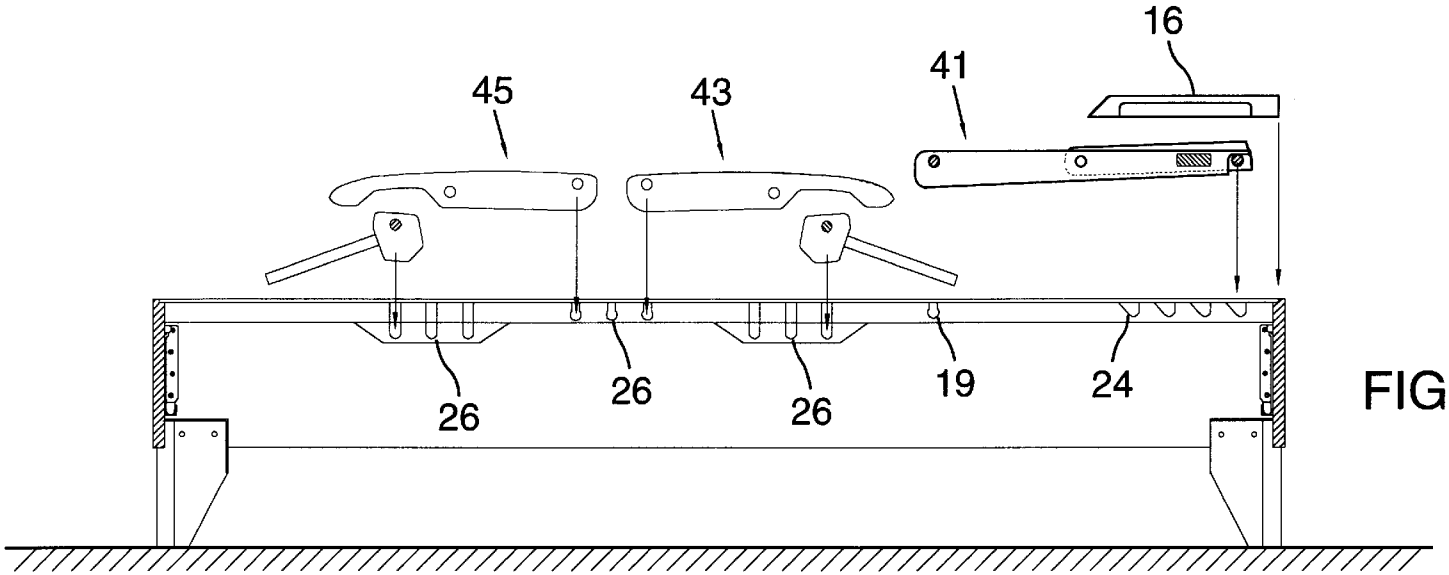
FIGS. 16–21 are side cross-sections showing the various elevating mechanisms in various positions.
Figure 17:
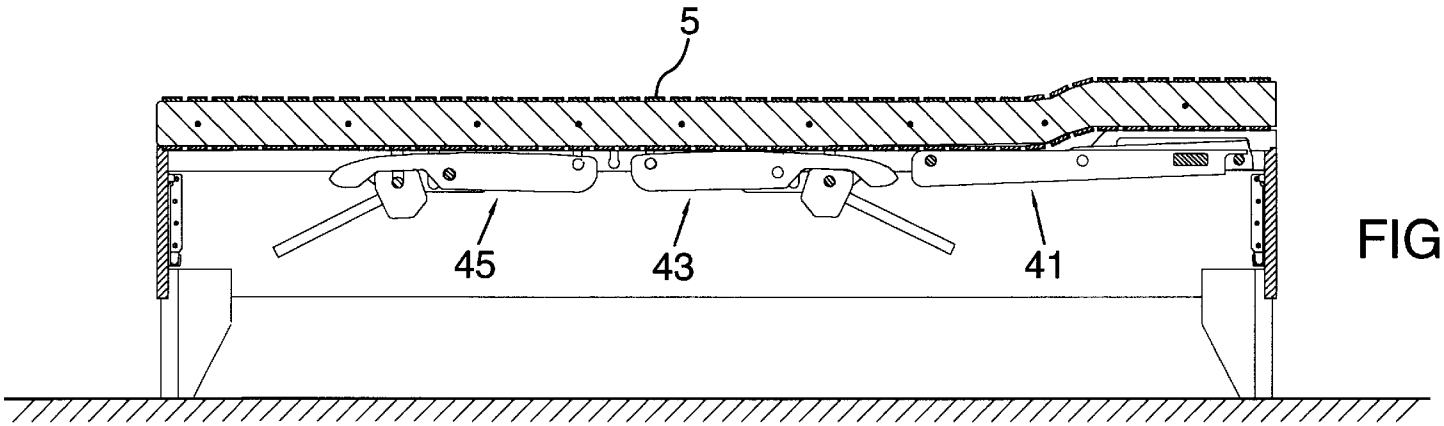
Figure 18:
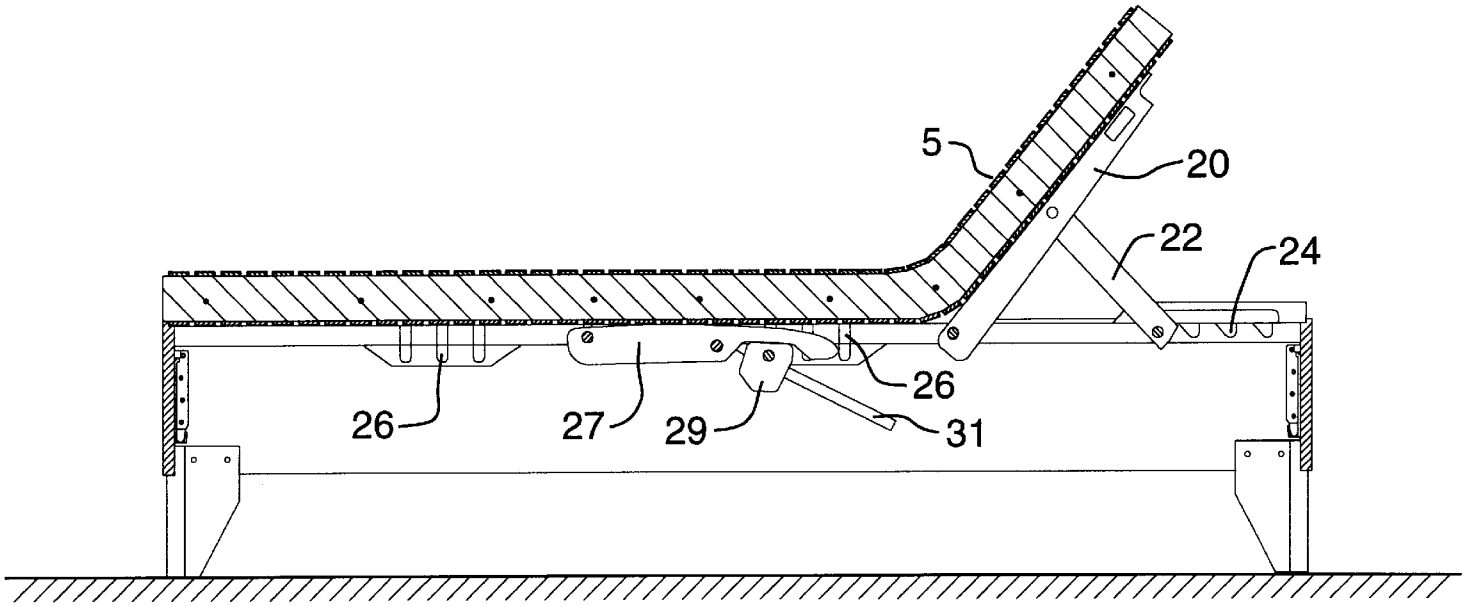
Figure 19:
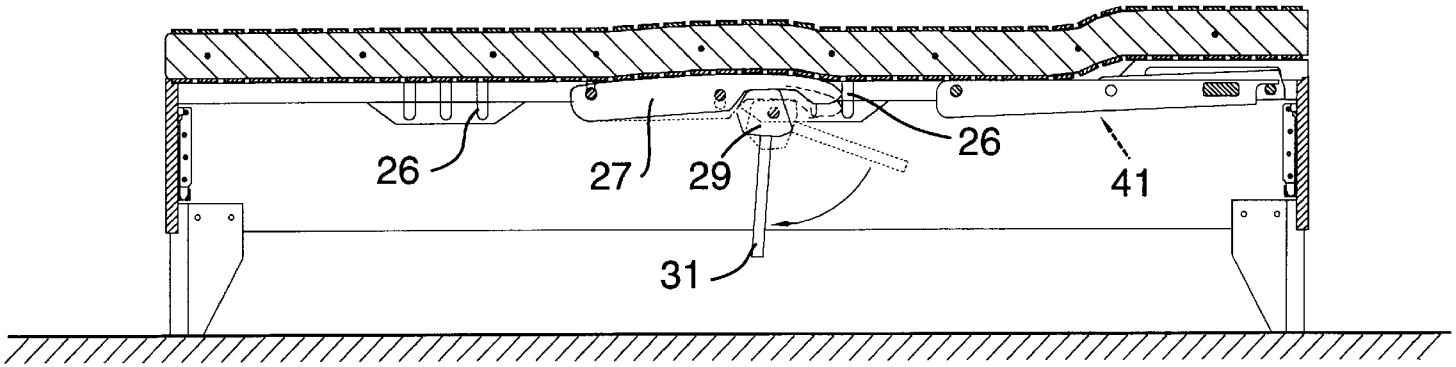
Figure 20:
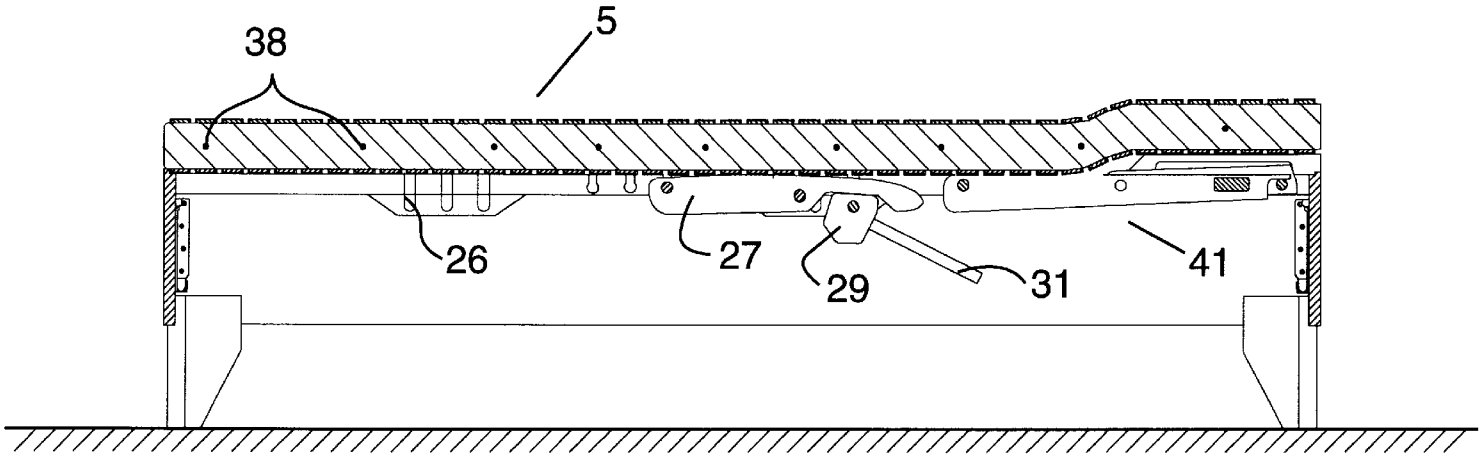
Figure 21:
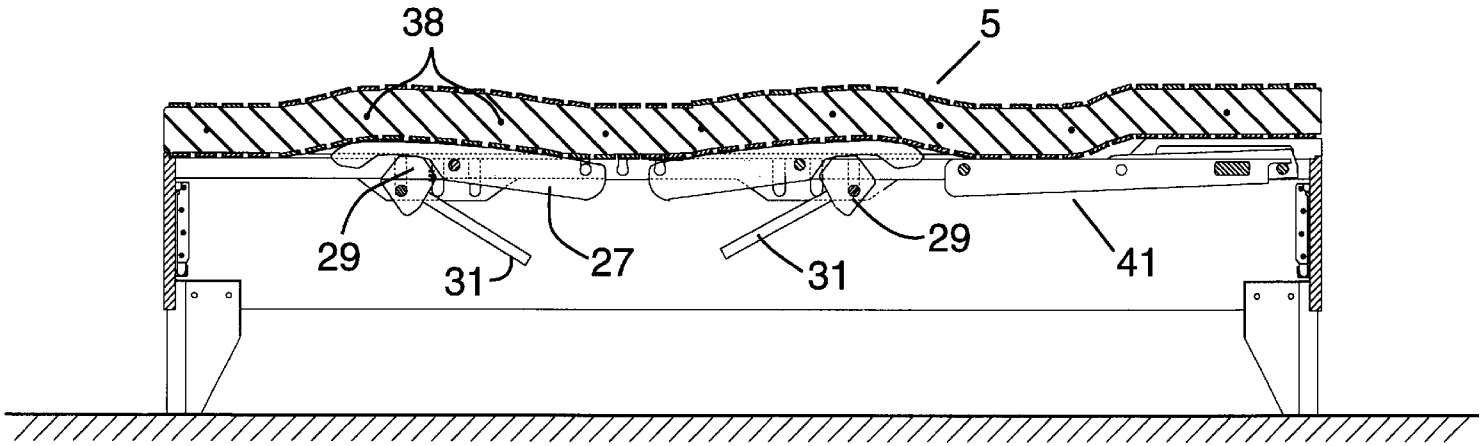

As illustrated in FIGS. 16, 17 and 21, an identical mechanism, with its direction reversed, can be employed to provide elevation of an area near the foot of the bed, to provide elevation for the legs. Some of the notches 26 can be used, or additional notches may be provided.

In the double, queen or king sized version of the invention, as seen in FIGS. 22–24, the identical principles are employed, but there is a central support member 32 running longitudinally between the head and foot panels, centrally between the side panels, with an upper surface at the same height as upper surfaces of the side panels. Two of the mattress assemblies are arranged side by side. The central support member has support rails 33 on either side thereof running the length thereof, corresponding to the support rails 17 in the single bed version of the invention, so that the individual mattress assemblies are supported in essentially identical fashion as in the single bed version.

Preferably, the central support member 32 is itself centrally supported by a support post assembly (not illustrated). The height of the support post assembly preferably may be adjusted as desired.

It will be appreciated that the above description relates to the preferred embodiments by way of example only. Many variations on the invention will be obvious to those knowledgeable in the field, and such obvious variations are within the scope of the invention as described and claimed, whether or not expressly described.

What is claimed as the invention is:

1. A bed system for a rectangular bed having two sides and head and foot ends, comprising:

a rectangular frame comprising four vertically-oriented panels, namely a head panel, a foot panel and two side panels;

a mattress assembly, said mattress assembly comprising upper and lower wooden strip layers separated by intervening rectangular elongated longitudinally-oriented foam blocks, each said wooden strip layer comprising a plurality of laterally-oriented wooden strips arranged in proximity to each other from head to foot of said frame, each strip extending from one side panel to the other side panel, said foam blocks comprising at least two outer blocks, one adjacent each side panel, and at least one intermediate block between said outer blocks, each said foam block running the length of said mattress assembly;

where said side panels have inwardly-facing shoulder portions running the length thereof, said wooden strips of said lower wooden strip layer resting on said shoulder portions, said outer foam blocks extending laterally outwardly beyond said wooden strips so as to have outer edges in general vertical alignment with outer walls of said side panels.

2. A bed system as recited in claim 1, where outer ends of said wooden strips are positioned in pockets provided in material strips along said outerfoam blocks, said pockets including means for blocking said strips from extending as far outwardly as said outer edges of said foam blocks.

3. A bed system as recited in claim 2, where said means for blocking said strips comprises a drawstring routed through outer portions of said pockets so as to substantially close said outer portions when drawn.

4. A bed system as recited in claim 1, further comprising means for preventing said outer foam blocks from moving laterally outwardly beyond said outer walls of said side panels.

5. A bed system as recited in claim 4, where said means for preventing said outer foam blocks from moving laterally outwardly beyond said wooden strips and said outer walls of said side panels comprises at least one element positioned along the outside of said outer foam blocks, said at least one element outside one outer foam block being tied to said at least one element outside said other outer foam block so as to prevent said outer foam blocks from moving farther apart than the distance between said elements.

6. A bed system as recited in claim 5, where said elements comprise a plurality of spaced-apart buttons.

7. A bed system as recited in claim 6, where opposing buttons are tied to each other by strings extending therebetween.

8. A bed system as recited in claim 1, further comprising mattress assembly elevating means pivotally mounted between said side panels, pivotable between lowered positions where said mattress assembly is not elevated above said frame, and at least one elevated position where at least a portion of said mattress assembly is elevated above said frame.

9. A bed system as recited in claim 8, where said mattress assembly elevating means comprises at least one of: (a) an upper elevating assembly to raise the upper portion of the bed towards a sitting position; (b) a central elevating assembly to raise a portion of the bed in the person's lumbar region; and (c) a lower elevating assembly to raise a portion of the bed in the area of the person's legs.

10. A bed system for a rectangular bed having two sides and head and foot ends, comprising:

a rectangular frame comprising four vertically-oriented panels, namely a head panel, a foot panel and two side panels;

a central support member running longitudinally between said head and foot panels, centrally between said side panels, with an upper surface at the same height as upper surfaces of said side panels;

two mattress assemblies arranged side by side, each said mattress assembly comprising upper and lower wooden strip layers separated by intervening rectangular elongated longitudinally-oriented foam blocks, each said wooden strip layer comprising a plurality of laterally-oriented wooden strips arranged in proximity to each other from head to foot of said frame, each strip extending from one side panel to said central support member, said foam blocks comprising at least two outer blocks, one adjacent a side panel and the other adjacent said central support member, and at least one intermediate block between said outer blocks, each said foam block running the length of said mattress assembly;

where said side panels have inwardly-facing shoulder portions running the length thereof, and said central support member has support rails on either side thereof running the length thereof, said wooden strips of each said lower wooden strip layer resting on said shoulder portions, said outer foam blocks extending laterally outwardly beyond said wooden strips so as to have outer edges in general vertical alignment with outer walls of said side panels or with a centerline of said central support member as the case may be.

11. A bed system as recited in claim 10, where outer ends of said wooden strips are positioned in pockets provided in material strips along said outerfoam blocks, said pockets including means for blocking said strips from extending as far outwardly as said outer edges of said foam blocks.

12. A bed system as recited in claim 11, where said means for blocking said strips comprises a drawstring routed through outer portions of said pockets so as to substantially close said outer portions when drawn.

13. A bed system as recited in claim 10, further comprising means for preventing said outer foam blocks of each mattress assembly from moving laterally outwardly beyond a distance between each said outer wall and said central support member.

14. A bed system as recited in claim 13, where said means for preventing said outer foam blocks from moving laterally outwardly beyond said distance comprises at least one element positioned along the outside of said outer foam blocks, said at least one element outside one outer foam block of a mattress assembly being tied to said at least one element outside said other outer foam block of that mattress assembly so as to prevent said outer foam blocks from moving farther apart than the distance between said elements.

15. A bed system as recited in claim 14, where said elements comprise a plurality of spaced-apart buttons.

16. A bed system as recited in claim 15, where each said mattress assembly has opposing buttons tied to each other by strings extending therebetween.

17. A bed system as recited in claim 10, further comprising, for each mattress assembly, elevating means pivotally mounted between said side panel and said central support member, pivotable between lowered positions where said mattress assembly is not elevated above said frame, and at least one elevated position where at least a portion of said mattress assembly is elevated above said frame.

18. A bed system as recited in claim 17, where said mattress assembly elevating means comprises at least one of: (a) an upper elevating assembly to raise the upper portion of the bed towards a sitting position; (b) a central elevating assembly to raise a portion of the bed in the person's lumbar region; and (c) a lower elevating assembly to raise a portion of the bed in the area of the person's legs.

* * * * *